US008991126B2

(12) United States Patent
Pendley et al.

(10) Patent No.: US 8,991,126 B2
(45) Date of Patent: Mar. 31, 2015

(54) FALL PROTECTION SYSTEMS AND METHODS

(71) Applicants: Timothy Pendley, Madera, CA (US); Michael J. McLain, Green Bay, WI (US)

(72) Inventors: Timothy Pendley, Madera, CA (US); Michael J. McLain, Green Bay, WI (US)

(73) Assignee: T&M Inventions, LLC, Green Bay, WI (US)

( * ) Notice: Subject to any disclaimer, the term of this patent is extended or adjusted under 35 U.S.C. 154(b) by 0 days.

(21) Appl. No.: 13/894,889

(22) Filed: May 15, 2013

(65) Prior Publication Data

US 2013/0305623 A1 Nov. 21, 2013

Related U.S. Application Data

(60) Provisional application No. 61/648,769, filed on May 18, 2012.

(51) Int. Cl.
*E04G 21/32* (2006.01)

(52) U.S. Cl.
CPC ..... *E04G 21/3266* (2013.01)
USPC ..... 52/506.06; 52/506.05; 52/799.12; 182/138

(58) Field of Classification Search
USPC ..... 52/741.1, 745.01, 192–197, 408, 676, 52/96, 63, 741.3, 745.06, 506.05, 748.1, 52/506.04, 506.06, 799.1, 799.11, 799.12; 210/473–474, 477, 482, 499; 245/1–3; 182/137–139; 482/23
See application file for complete search history.

(56) References Cited

U.S. PATENT DOCUMENTS

| | | | | |
|---|---|---|---|---|
| 5,201,152 | A * | 4/1993 | Heffner | 52/64 |
| 5,251,415 | A | 10/1993 | Van Auken et al. | |
| 5,406,764 | A | 4/1995 | Van Auken et al. | |
| 5,901,518 | A * | 5/1999 | Harkins | 52/404.3 |
| 6,226,945 | B1 | 5/2001 | Henry et al. | |
| 6,347,277 | B2 * | 2/2002 | Amtmann et al. | 701/114 |
| 6,401,426 | B1 * | 6/2002 | Alderman et al. | 52/749.12 |
| 6,748,715 | B1 * | 6/2004 | Black et al. | 52/660 |
| 6,840,015 | B1 * | 1/2005 | Ashley | 52/90.1 |
| 2013/0108377 | A1 * | 5/2013 | Steffenino | 405/302.3 |

* cited by examiner

*Primary Examiner* — Jeanette E. Chapman
(74) *Attorney, Agent, or Firm* — Thomas D. Wilhelm; Wilhelm Law, S.C.

(57) ABSTRACT

Fall protection systems, methods of installing such systems, and buildings embodying such systems. Such fall protection system extends from structure elements of the building about an encompassed space into which there is risk of a person falling. An open-mesh web is supported from the structure elements and overlies, and extends across, the space. A perimeter band extends about the encompassed space. The perimeter band is secured to the building structure elements about the space and thus entraps the web between the band and the building structure elements. The web may also be supported in the space by supplemental supports, which can be crossing support bands, attached to the structure elements, or intervening e.g. walls within the space. The web is left in place and is covered by internal finish materials whereby the web is captured between internal finish materials and ceiling and/or floor members in the finished building.

22 Claims, 4 Drawing Sheets

FALL PROTECTION SYSTEMS AND METHODS

BACKGROUND OF THE INVENTION

This invention relates to buildings, building components, building subassemblies, and building assemblies, and to methods of constructing buildings. This invention relates specifically to building structure elements, and to the issue of worker safety during the construction of buildings.

From time to time, injuries occur during building structure elements, including to workmen who fall from an elevated height.

There are standard and required practices to provide capture and support material below workers who are working at substantial height above a supporting surface, to protect them, namely to catch and support them if/when they fall. A typical such material is a net-like material, which acts as a passive fall-protection system.

According to the prior art, first the net is installed; the work is performed, and then the net is taken down. Installing and taking down the net is a labor intensive, and therefore a costly, process. Given the time and cost involved in using a net, such netting is sometimes not used, whereby the workers, who are supposed to be protected by netting, remain at risk. Because use of netting has not been adopted in essentially all high-elevation jobs, the workers working on corresponding such jobs remain at risk, whereby netting, alone, is not an operationally acceptable solution for worker safety.

In the alternative, no net is used, workers working at substantial heights above a safe support are required to be tied or tethered to the structure being constructed or otherwise worked on.

But tethers, too, have only limited effect. Sometimes the limited effect is caused by contractor failure to enforce rules and/or regulations which require use of tethers. Sometimes the limited effect is caused by worker failure to follow instructions, Whatever the cause, when a worker does not attach a required tether, or while a tether is being attached, detached, and/or moved, the worker is at risk.

Accordingly, there is a need for a passive fall protection system which, once installed, cannot be avoided, and which does not require a proactive act on the part of the individual worker in order to be effective.

There is further a need for an open-mesh web/net as part of a fall protection system.

There is still further a need for a more cost-effective open-mesh web/net as part of a fall protection system where the open-mesh web/net can be left in place after use, and incorporated into the structure of the finished building.

There is further a need for a method of installing a fall protection system where an open-mesh web/net is installed over an open expanse and about the outer perimeter of a generally encompassed space, and is held in place by a perimeter band.

These and other needs are alleviated, or at least attenuated, or partially or completely satisfied, by novel products and methods of the invention.

SUMMARY OF THE INVENTION

This invention provides fall protection systems, methods of installing fall protection systems, and buildings built using such fall protection systems. The fall protection systems comprise a supporting framework which extends about an encompassed space into which there is a risk of a person falling. An open-mesh web/net is supported from the supporting framework and overlies, and extends across, the encompassed space. A perimeter band extends about the encompassed space proximate the supporting framework. The perimeter band extends over at least portions, optionally edge portions, of the open-mesh web proximate the top of the supporting framework, and may be laced into and out of ones of the open cells about the perimeter of the supporting framework. The web is thus entrapped between the perimeter band and portions of the supporting framework, and optionally is captured by the perimeter band. The perimeter band is secured to the supporting framework at spaced locations about the encompassed space. In addition to the web being supported across the encompassed space by the supporting framework, the web may also be supported in the encompassed space by first and optionally second, or more, sets supplemental supporting structures which intrude into and/or cross the encompassed space. The supplemental supporting structures can be crossing sets of support bands which are attached to the supporting framework. In the alternative, the supplemental supporting structures can be intervening frameworks, such as intervening walls, within the encompassed space. In a finished building where a fall protection system of the invention was used in constructing the building, the open-mesh web is left in place in the finished building and is covered by internal finish materials such that the web is captured between the internal finish materials and e.g. ceiling and/or floor framing members.

In a first family of embodiments, the invention comprehends, in a building structure elements, building structure elements defining a wall which defines an encompassed space, the wall having a wall bottom, a wall top, and upright connectors extending upwardly between the wall bottom and the wall top, the wall top comprising one or more top plate elements, a given top plate element having at least one of an upwardly-facing top surface and an outer surface facing away from the encompassed space, and an open expanse extending across such encompassed space. A fall protection system extends across the open expanse, and comprises an open-mesh web overlying, and extending across, the encompassed space proximate the wall top, the open-mesh web comprising a matrix of open cells; and a perimeter band extending about the encompassed space proximate the wall, the perimeter band extending over at least portions of the open-mesh web proximate the wall top, the perimeter band being secured to the building structure elements proximate the wall at spaced locations along the wall, thereby entrapping the at least portions of the open-mesh web between the perimeter band and the respective building structure elements along the wall.

In some embodiments, the perimeter band is laced into and out of the open cells of the open-mesh web proximate the wall top whereby the open-mesh web is captured by the perimeter band.

In some embodiments, a first set of support bands extends, as supplemental supporting structure, in a first direction across the open expanse under the open-mesh web, each support band in the first set being attached to first opposing sides of the generally enclosing wall, adjacent upper portions of the wall, the first set of support bands supporting the open-mesh web such that the open mesh web is generally at an elevation proximate the wall top over the open expanse, allowing for some reasonable sag in the web, and optionally a second set of support bands extends in a second direction, different from the first direction, across the open expanse under the open-mesh web, each support band in the second set being attached to second opposing sides of the generally enclosing wall, adjacent the upper portions of the wall, the second set of support bands crossing the first set of support bands, whereby the first and second sets of support bands define a generally common and coordinated support, the open-mesh web extending over, and being supported by, at least portions of both the first and second sets of support bands.

In some embodiments, some or all of the lengths of the support bands are laced through ones of the open cells of the web across the open expanse of the encompassed space, thus to pass both above and below the web across the open expanse whereby the open-mesh web extends over some, but not all, of the lengths of the support bands across the open expanse.

In some embodiments, the generally enclosing wall has an outer surface, the open-mesh web extending downwardly from proximate the wall top along a portion of the outer surface of the wall.

In some embodiments, the perimeter band has a length, a width, and a thickness, the perimeter band being secured to the outer surface of the wall with the width of the perimeter band extending in an upright orientation such that the open-mesh web turns an approximately perpendicular angle between a first portion of the web which is captured by the perimeter band and a second portion of the web which extends toward and/or across the open expanse.

In some embodiments, the open-mesh web comprises knots at respective corners of the open cells.

In some embodiments, the open-mesh web comprises a monolithic, substantially polymeric, structure.

In some embodiments, the perimeter band is attached to the building structure elements proximate the wall at locations spaced no more than about 24 inches (0.6 meter) apart.

In some embodiments, the perimeter band comprises a polymeric band.

In some embodiments, the support bands comprise metal bands.

In some embodiments, when the fall protection system is stressed by an object, up to about 181 kg (400 pounds), being dropped into the open expanse from a height of up to about 107 cm (42 inches), the fall protection system captures and supports the object in less than about 2.4 meters (8 vertical feet) of supported drop.

In a second family of embodiments the invention comprehends a building, comprising building structure elements defining a generally enclosing wall which, in turn, defines an encompassed space, the wall having a wall bottom, a wall top, and upright connectors extending upwardly between the wall bottom and the wall top, the wall top comprising one or more top plate elements, a given top plate element having at least one of an upwardly-facing top surface and an outer surface facing away from the encompassed space, an open expanse extending across such encompassed space; ceiling and/or floor members extending across the open expanse and overlying the encompassed space; a fall protection system extending across the encompassed space, the fall protection system comprising an open-mesh web overlying, and extending across, the encompassed space proximate the wall top, the open-mesh web comprising a matrix of open cells; and a perimeter band extending about the encompassed space proximate the generally enclosing wall, the perimeter band extending over at least portions of the open-mesh web proximate the wall top, the perimeter band being secured to the building structure elements proximate the wall at spaced locations along the wall, thereby entrapping the at least portions of the open-mesh web between the perimeter band and the generally enclosing wall along the wall; and internal finish materials covering the ceiling and/or floor framing, and capturing the open-mesh web between the internal finish materials and the ceiling and/or floor members.

In a third family of embodiments, the invention comprehends, in a building construction where building structure elements define a generally enclosing wall which, in turn, defines an encompassed space, the wall having a wall bottom, a wall top, and upright connectors extending upwardly between the wall bottom and the wall top, the wall top comprising one or more top plate elements, a given top plate element having at least one of an upwardly-facing top surface, and an outer surface facing away from the encompassed space, and an open expanse extending across the encompassed space, a method of installing a fall protection system across the open expanse, the method comprising placing an open-mesh web across the open expanse, and over the encompassed space, and extending the open-mesh web across a portion of the building structure elements proximate the wall top, the open-mesh web comprising a matrix of open cells, each surrounded by web elements; and securing the open-mesh web to ones of the building structure elements about the encompassed space and proximate the wall, by extending a perimeter band over at least portions of the open-mesh web proximate the wall top, and securing the perimeter band to ones of the building structure elements proximate the wall at spaced locations along the wall and thereby entrapping the at least portions of the open-mesh web between the perimeter band and the respective building structure elements along the wall.

In some embodiments, the method includes lacing the perimeter band progressively into and out of respective ones of the open cells about the enclosed space and subsequently securing the perimeter band to the building structure elements proximate the wall.

In some embodiments, the method further comprises extending a first set of support bands in a first direction across the open expanse, and attaching respective ones of the first set of support bands to first opposing sides of the wall, the open-mesh web extending over at least portions of the first set of support bands, and being supported by the first set of support bands, and optionally extending a second set of support bands in a second direction, different from the first direction, across the open expanse, and attaching respective ones of the second set of support bands to second opposing sides of the wall, the first and second sets of support bands defining a coordinated support, the open-mesh web extending over, and being supported by the first, and optionally the second, sets of support bands.

In some embodiments, the wall has an outer surface, the method further comprising extending the open-mesh web downwardly from proximate the wall top along a portion of the outer surface of the wall, the perimeter band having a length, a width, and a thickness, and securing the perimeter band to the outer surface of the wall with the width of the perimeter band in an upright orientation.

In some embodiments, the method further comprises selecting, as the open-mesh web, a web having knots at respective corners of the cells.

In some embodiments, the method further comprises selecting, as the open-mesh web, a monolithic, substantially polymeric web.

In some embodiments, the method further comprises fastening the perimeter band to the building structure elements at locations spaced no more than about 24 inches (0.6 meter) apart.

In some embodiments, the method further comprises selecting polymeric banding material for the perimeter band.

In some embodiments, the method further comprises selecting metal banding material for the support bands.

BRIEF DESCRIPTION OF THE DRAWINGS

Illustrative embodiments of the invention are described hereinafter, by way of examples only, with reference to the accompanying drawings.

Figure 1:
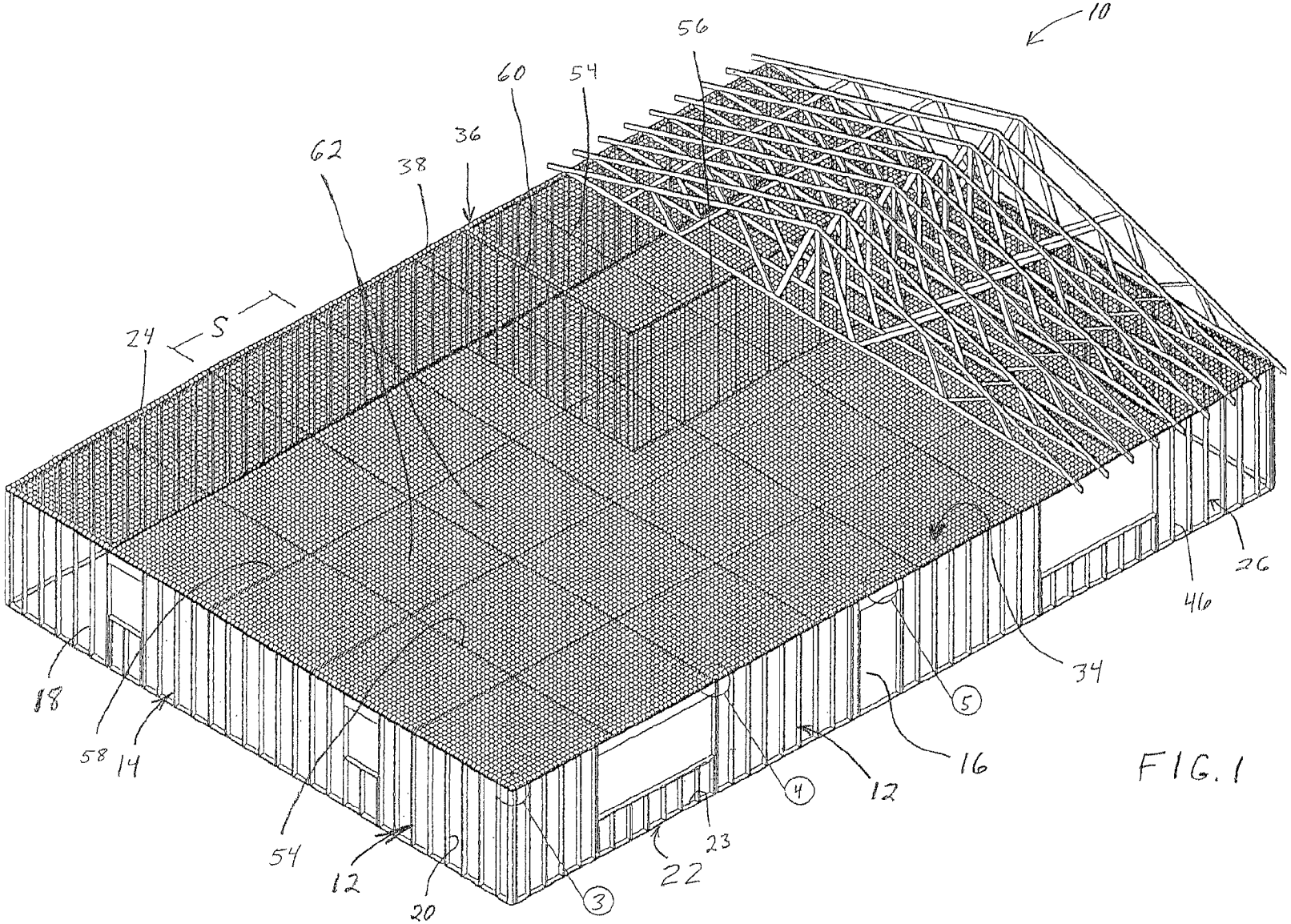
FIG. 1 shows a pictorial view of a first embodiment of fall protection systems of the invention used at the top of the ground floor of a building.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

FIG. 1 generally shows a partially-constructed building 10. As illustrated in FIG. 1, building 10 includes a plurality of building structure elements which, among other things, define upright side walls 12, which in turn define a collective wall 14 which extends about an encompassed space 16. Wall 14 has an outer surface 18 facing away from the encompassed space 16 and an inner surface 20 facing into encompassed space 16, a wall bottom 22 including a bottom plate 23, a wall top 24 extending about the outer perimeter, and upright studs 26 extending upwardly, and operating as upright connectors, between the wall bottom and the wall top. Wall 14 includes a top plate 28, seen in FIGS. 3-5. Top plate 28 is defined by a plurality of plate elements which collectively extend about the perimeter of wall 14. Top plate 28 is attached to each of studs 26, such as by nails or screws, optionally through an intervening metal plate, thus tying the studs and top plate to each other as elements of the wall structure. Each top plate element has an upwardly-facing top surface 30 and an outer surface 32 facing away from encompassed space 16. An open expanse 34 extends across the encompassed space between opposing sides of enclosing wall 14.

A fall protection system 36 extends across the open expanse of the encompassed space. Fall protection system 36 includes an open-mesh web 38 overlying, and extending across, encompassed space 16, supported by underlying support members as required according to the distance between fixed wall supports. Referring to FIG. 3, open mesh web 38 has a first plurality of generally parallel warp strands 40 extending along the length of the building and a second, plurality of generally parallel weft strands 42 extending across the width of the building. The warp and weft strands collectively define a corresponding plurality of open cells 44. Each open cell 44 is bordered by first and second warp strands on a first opposing pair of sides of the cell and by third and fourth weft strands on a second opposing pair of sides of the cell, Thus, each of the cells. as illustrated in FIGS. 1-5, has four sides.

Figure 3:
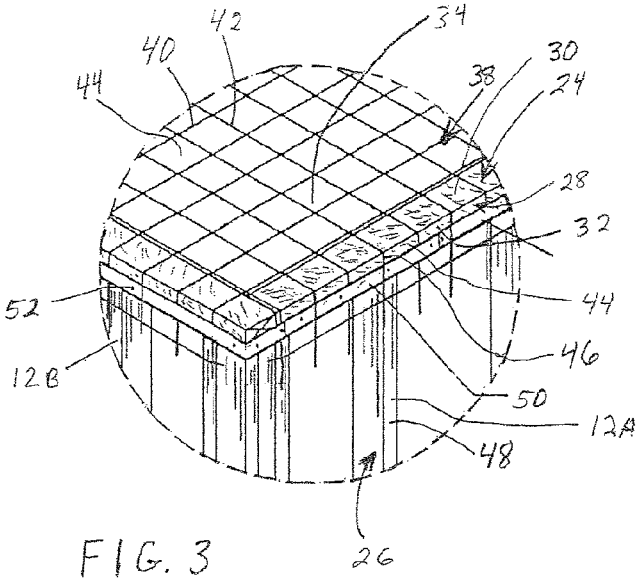
FIG. 3 is an enlarged view taken at "circle 3" in FIG. 1.
Figure 4:
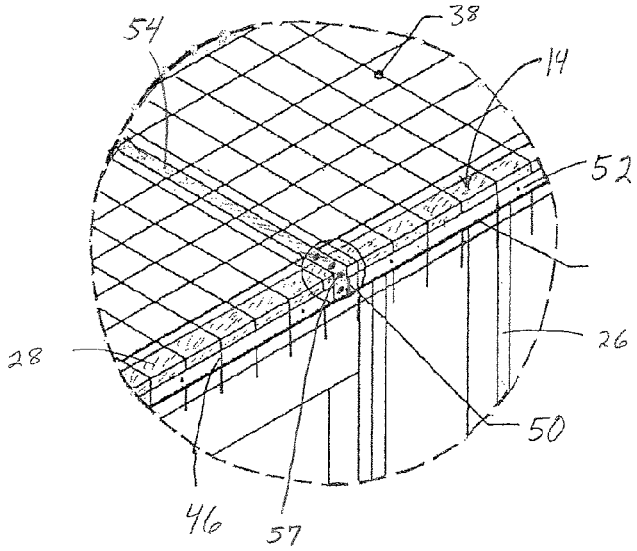
FIG. 4 is an enlarged view taken at "circle 4" in FIG. 1.
Figure 5:
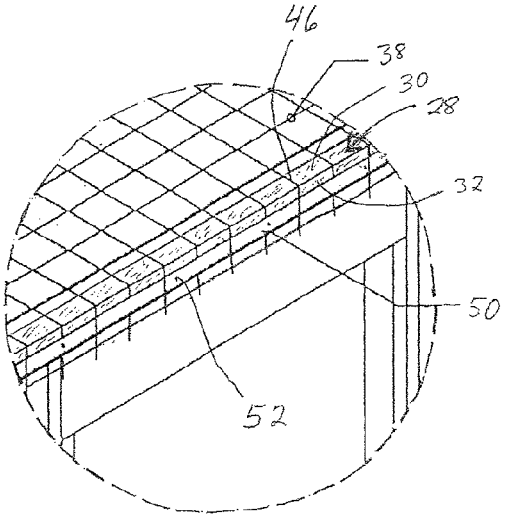
FIG. 5 is an enlarged view taken at "circle 5" in FIG. 1.

As illustrated in FIGS. 3-5, the outer edges 46 of web 38 extend over the top surfaces 30 of the respective top plate elements and down over outer surfaces 32 of those top plate elements, optionally downwardly over top portions of the outer surfaces 48 of studs 26.

A perimeter band 50 is laced into and out of respective ones of open cells 44 about the outer perimeter of wall 14. In the illustrated embodiments, perimeter band 50 is laced into and out of every other cell, thus over and under each alternating weft strand 42 on a first side wall 12A and over and under each alternating warp strand 40 on a second adjacent side wall 12B. By such lacing of the perimeter band 50 into and out adjacent ones of the cells, the perimeter band captures the outer edge portions of the web such that the locations of the outer edge portions of the web, in general, are captured and controlled by, are slave to the location, of perimeter band 50.

Perimeter band 50 is attached to enclosing wall 14, e.g. at top plate 28 about the outer perimeter of enclosing wall 14. FIGS. 3-5 show the perimeter band attached to the top plate at outer surface 32. In some embodiments, perimeter band 50 can be attached to the top plate at top surface 30. In some embodiments, perimeter band 50 is attached to the outer surfaces 48 of the studs, typically but not necessarily, at top portions of the studs. Perimeter band 50 is attached to enclosing wall 14 at spaced locations along the length of the enclosing wall, optionally at least every 39 inches (100 cm) along the length of the enclosing wall, optionally at least every 24 inches (61 cm). Such attachments of the perimeter band to the enclosing wall, for example with strands of the web disposed between the band and a respective building structural element such as the top plate, can be by e.g, elongate mechanical fasteners such as screws or nails 52 which, as illustrated in FIGS. 3-5, extend through the perimeter band into the respective building structural element. Where the web extends about the fastener. namely the web completely surrounds the fastener so as to define an o en cell 44 which contains the fastener so long as a strand of the cell is between the fastener and open space beyond the web, it can be said that the fastener passes/extends through the open cell of the web.

An example of band material which has been found acceptable for perimeter band 50 is a polymeric band, one inch (2.5 cm) wide, made from nylon 66. Such band material is available from Dynapak Inc., Panolo, Tex., as ULTRABAND U8195-16W. A primary requirement of band 50 is that the band be strong enough to tolerate any expected stress on the web as a person falls onto the web, whereby the web catches and supports the fallen person. Thus, there is a strength requirement of band 50. In addition, band 50 cannot have sharp edges which might/would cut strands 40, 42 of the web. Thus, a metal band having sharp edges is not acceptable for band 50. However, a metal band having rounded, non-cutting, edges is acceptable for band 50.

Referring again to FIG. 1, a first set of support bands 54 extends across the width of building 10 under web 38, and in contact with the bottom of the web, such that the first set of bands support the web along the width dimension of the building. in the illustrated embodiments, support bands 54 extend generally parallel to each other, and are spaced from each other by a specified distance. Each band 54 is attached to opposing sides of enclosing wall 14 or other building structure, optionally to a first intervening wall 56, such that the so-attached band provides the recited support to the web.

Each band 54 is attached to e.g. a stud 26 or to top plate 28 by one or more mechanical fasteners such as screws or nails 52 or by one or more clamps.

A second set of support bands 58 extends along the length of the building, also under web 38, also in contact with the bottom of the web, such that the second set of bands supports the web along the length dimension of the building. In the illustrated embodiments, support bands 58 extend generally parallel to each other, and are spaced from each other by a specified distance. Each band 58 is attached to opposing sides of enclosing wall 14 of other building structure, optionally to an intervening wall 60, such that the so-attached band provides the recited support to the web. Each band 58 is attached to e.g. a stud 26 or to top plate 28 by one or more mechanical fasteners such as screws or nails 52 or by one or more clamps.

At locations away from all wall support from the building structure, the spacings between the respective support bands create a plurality of generally otherwise unsupported blocks 62 of the material of web 38, each unsupported block of the web material being bounded by bands 54 and 58, such that the bands provide support about the perimeter of each respective block 62.

While the illustrated sets of support bands are shown with the bands parallel to each other, the bands need not be parallel, although parallel relationship is believed to be more cost effective. The band sets are shown as being perpendicular to each other, and perpendicular to enclosing wall 14. Other orientations of the bands to each other, such as not perpendicular to each other, are contemplated. Other orientations of the bands to wall 14, such as not perpendicular to the enclosing wall, are also contemplated The important parameter is that the bands provide adequate support to the web at sufficient intervals that the web extending across each respective unsupported block is enabled to catch, and to at least temporarily safely retain and support, a person who falls onto the web which extends across in the respective block.

Blocks which are adjacent one or more upright side walls 12 are in part supported by the respective side walls and are in part supported by the support bands. Where the web passes over an intervening wall such as at 56 or 60, the web may permissively be attached to the intervening wall, as well as being attached to enclosing wall 14.

Bands 54, 58 are typically metal bands, which have little effective elongation under modest tension. Bands 54, 58 are typically not elongated when installed; and such bands undergo minimal, if any, elongation when loaded by a typical fall of a person onto web 38. A typical metal band useful in the invention for support bands 54, 58 is available from Clark Western Building Systems, West Chester, Ohio, as 1150FS-33 Flat Strapping. Such strapping, as received from the fabricator, is 1.5 inch (3.8 mm) wide, 20 gauge thickness, and of indeterminate length, for example wound as a roll of such strapping. Other bands which have suitable tensile strength, as well as suitable non-elongation properties, and being free from sharp edges, can be used as well.

Bands 54, 58 are installed at the top of wall 14 on the partially-completed building, and are attached to wall 14, and are drawn snug, so as to have limited sag, though reasonable sag is acceptable, across open expanse 34, such that the web is generally supported well above the elevation of wall bottom 22. With the web thus elevated, and supported about each unsupported block 62, the individual blocks provide localized support to an object falling onto the block. Namely, the web provides the immediate support, providing primary absorption of the force of the fall. The web transfers a substantial fraction of the force of the fall to the bands, The bands and web collectively transfer the overall force of the fall to the building structure, such as to wall 14 and any intervening walls.

A person falling onto the web encounters the web several feet vertically above an underlying support such as a floor/substrate at the elevation of e.g. wall bottom 22. The web has that vertical distance to the underlying support in which to break the person's fall and provide a safe support o the fallen person.

Figure 6:
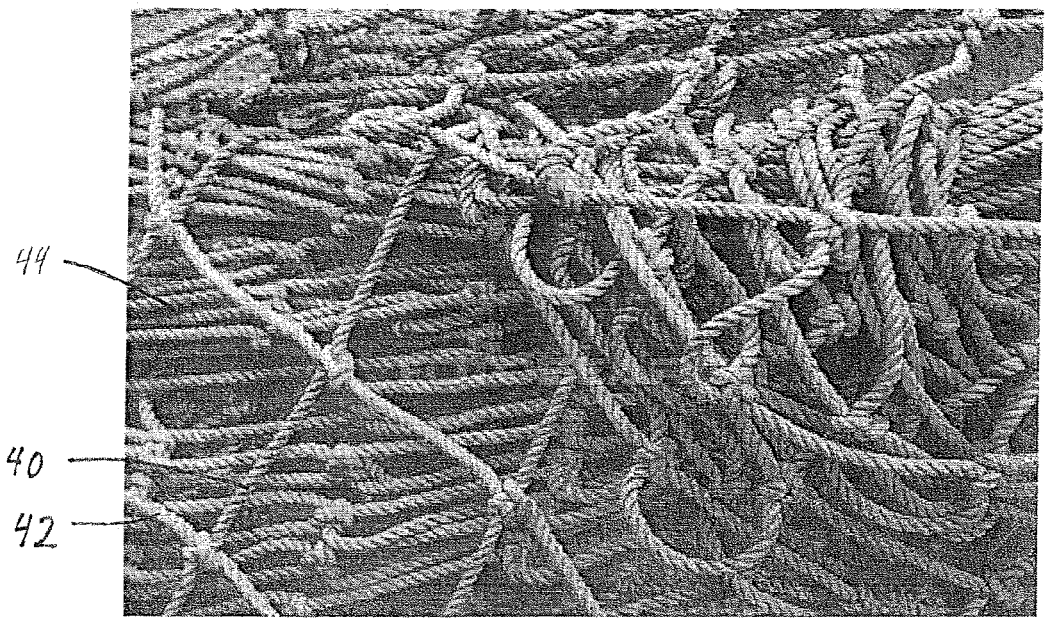
FIG. 6 shows a first embodiment of an open-mesh web useful in the invention.
Figure 7:
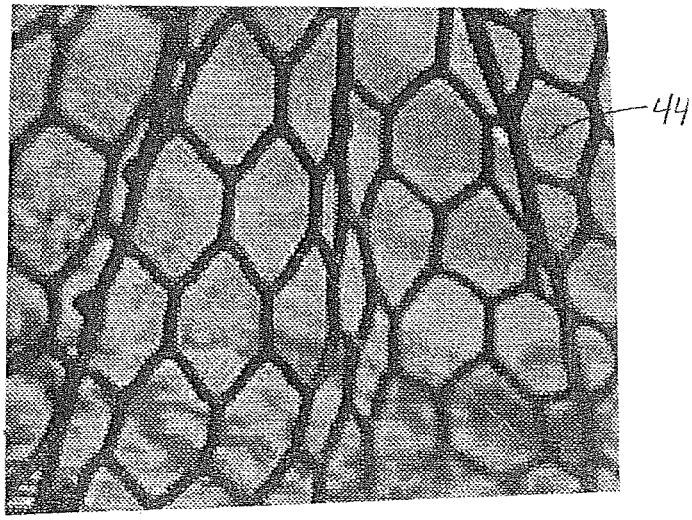
FIG. 7 shows a second embodiment of an open-mesh web useful in the invention.

FIGS. 6 and 7 illustrate two embodiments of materials which can be used as open-mesh web 38.

FIG. 6 illustrates a knotted web, which can be, for example and without limitation, what is commonly referred to as fishing net. Such fishing net is made with twisted twines, and each cell 44 has four generally equal-length sides. Knots are provided at each intersection of the twines so as to fixedly establish the dimension of the respective sides of the cell. In an exemplary such web, the twine is about 2 mm to about 4 mm, optionally about 2.5 mm to about 3 mm diameter, and the distance between knots is about 20 to about 100 mm, optionally about 60 mm to about 90 mm, optionally about 80 mm, Such webbing is generally fabricated in indeterminate lengths, and to certain maximum widths. Where a greater width is specified, multiple webs can be joined to each other along respective adjoining sides of the webs by sewing the webs together along the respective sides of the webs.

The twine, itself, is generally non-extensible, e.g. has substantially limited extensibility, under the forces encountered when a person falls onto the web. In a relaxed condition, the open cells typically exhibit four-sided diamond shapes. When a typical falling force is applied to the web, the force distorts the diamond-shaped relaxed structure of the open cells 44, and causes a tightening of the knots, such that the web strands become aligned with each other in directions radiating away from the location where the force is applied. The webbing is permanently distorted at the location where the force is being applied. Such webbing is available from Diamond Nets, Inc. Everson, Wash., USA.

FIG. 7 illustrates a polymeric web, made with thermoplastic material such as nylon, polyester, or the like. Strands which define the individual cells are shown arranged in a hexagonal pattern such that each cell has six equal-length sides. In the embodiment illustrated in FIG. 7, each strand/'side of a given cell is the same as each other strand/side of the cell, and the strands are continuous about the cell, such that a single monolithic structure defines a given cell, and typically defines adjacent cells in their entireties. The monolithic web in FIG. 7 is fabricated in defined maximum widths. Where a width is needed which is greater than can be produced as a monolithic web, multiple webs can be joined to each other along respective sides of the individual webs by e.g. melt bonding, sewing, or the like.

As used herein, reference to polymer use in web 38 includes all conventional uses of additive packages such as lubricants, softening agents, plasticizers, colorants, slip agents, anti-blocks, fillers, processing aids, and the like, The web, itself, has a certain ability to absorb some of the energy of the fall. In knotted webs such as that shown in FIG. 6, while the strands do not lengthen substantially in response to the energy of the fall, energy is absorbed by tightening of the knots and by distortion of the cells. The amount of knot tightening changes with distance from the location, on the web, where the force is applied.

Polymers used in webs illustrated in FIG. 7 are inherently extensible. Accordingly, stress applied to polymeric webs is at least partially absorbed by the extending of the web strands. Such extending of the web strands is not expected to be within the limits of Young's modulus whereby the web strands are not expected to return to their pre-stress configurations. Accordingly, the polymeric strands are permanently distorted such that the web is permanently distorted at the location where the force was applied.

In addition to the absorption, by the web, of a first portion of the energy of the fall, a second portion of the energy is absorbed by support bands 54, 58. Support bands 54, 58 deflect downwardly when a fall impacts the web. However, the support bands are largely non-extensible. Since the support bands do not otherwise deform substantially, either in structure or in form, other than the downward deflection, bands 54 and 58 function generally as energy transmitters, transmitting the remaining energy of the fall, from the location of the block where the fall impacted the web, to wall 14 and/or to any connected intervening wall or walls, or other building structure.

Safe support of a worker at risk of falling from an elevated location is sometimes defined in terms of successfully dropping a 400 pound bag of sand or the like from a distance of about 42 inches (107 mm) onto any portion of the web, and the web sustains the force of the fall and supports the so-dropped load. The ability to accommodate such fall, including respective energy absorptions of the web and the support bands, as well as transfer of residual energy to the building structure as at a respective wall or walls, depends on the energy absorption capacity of both the web and the support bands as well as the energy transmitting capabilities of the support bands.

Using a web as illustrated in FIG. 6, when the thread is generally non-extensible, where thread diameter is about 2.5 mm, where cell side length is about 8 mm, and where the support bands are generally non-extensible metal, where the vertical drop from the web to the underlying support/floor is about 8 feet (2.4 meters), spacing S between the support bands, both warp and weft, of no more than about 10 feet (3 meters), optionally no more than about 8 feet (2.4 meters) has been found satisfactory about an unsupported block. Thus, the unsupported block 62 of web 38 is about 8 feet (2.4 meters), or less, on each of e.g. 4 sides.

Where a web crosses an intervening wall, the intervening wall provides additional support in the respective otherwise unsupported blocks whereby the area defined within the respective otherwise unsupported blocks is correspondingly less.

Where the material and/or the structure of web 38 and/or bands 54, 58 is different from that described herein, the spacing between bands 54 or 58 may be more, or less, depending on the abilities of the respective materials to safely absorb the energy of a person's fall.

Figure 2:
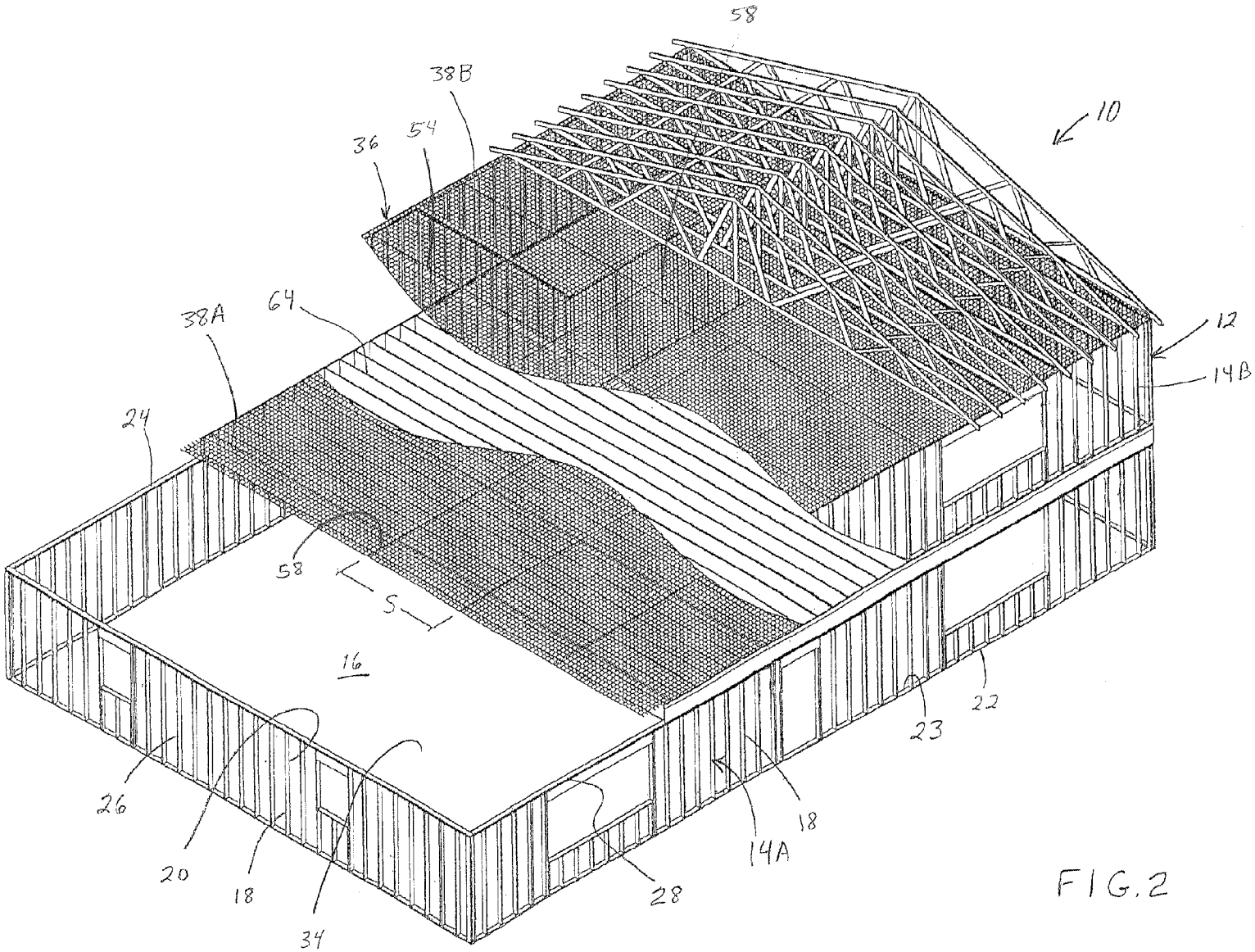
FIG. 2 is a pictorial view, with parts removed, showing a fall protection system as in FIG. 1 used at the top of the second floor of the building under a set of roof trusses, and a second fall protection system of the invention used over floor trusses at the top of the ground floor.

FIG. 2 illustrates use of web 38 at two locations in a two-story building. On the first floor, a set of floor trusses 64 overlies and/or is otherwise attached to first floor wall 14A at the top of the wall. A first web 38A extends over the floor trusses and the edges of web 38A extend downwardly over ends of the trusses, or the sides of the end truss, optionally down over a portion of the outer surface 18 of the wall.

Web 38A is supported across the width of the building structure by trusses 64 at regular truss intervals such as at 16 inch (41 cm) intervals or 24 inch (61 cm) intervals. Accordingly, the unsupported blocks of web, between adjacent ones of the trusses 64, are sufficiently small in the length dimension of the building that support bands 54 across the width of the building are not needed, and are not used. However, support bands 58 are still used to limit the spacing between the top plate elements which support web 388 along the length of the building structure, on the opposing sides of the building.

As in FIG. 1, the outer edge portions 46 of the web can be attached to the ends or sides of the trusses, or to wall 14A, by perimeter band 50. Thus, in the embodiment of the fall protection system represented by web 38A, perimeter band 50 can still be laced into and out of cells 44 of the web along the edge portions of the web; and band 50 can still be attached to the building structure at first floor wall 14A as at top plate 28, or at the trusses, or at any other building structure which is available for securely attaching the web to the building structure at the outer edge portions of the web. The necessary parameter is that the edge portions of the web be fixedly secured to a generally immovable portion of the building structure such as an upright wall. And given the interface between web 38A and underlying trusses 64, the web strands can optionally be secured to the tops of the trusses at spaced locations along ones of the trusses, such as by staples.

Returning specifically to FIG. 2, a second web 388 extends across an open expanse 34, across the width and length of the second floor of the building as defined by second floor enclosing wall 148. in FIG. 2, portions of the webs and bands are removed in order to show multiple levels of the building structure. Web 38B extends the full length and width of the building structure. Bands 54 extend across the width, and are spaced along the length of the building structure. Bands 58 extend along the length of the building structure, and are spaced across the width of the building structure. Including intervening walls, building attachment support of web 388 in FIG. 2, to the building structure, is the same as building attachment support of web 38 in FIG. 1 to the building structure. Thus, support bands 54, 58 support web 388 about the entirety of open expanse 34 as defined by second story enclosing wall 14B.

The illustrated embodiments show perimeter band 50 laced into and out of edge portions of web 38, whereby such lacing captures edge portions of the web, thus fixing the locations of the edge portions of the web relative to the band by potential lateral interference between the band and the respective web strands.

The perimeter band can be laced in other patterns such as every other open cell, or every third, or every fourth or the like, open cells.

In some embodiments, the perimeter band is not laced through the web. Rather, the web is mounted and stretched over the encompassed space and stretched edges of the web extend down over the outer surfaces of walls 12. While the web is so stretched, the perimeter band is mounted over the stretched web at the edges of the encompassed space, such as at the outer surface of the top plate. The band is then attached/secured to the enclosing wall with the web being trapped, and held by friction, against ones of the building structural elements, between the web, the perimeter band, and the structure elements of the wall. The fasteners used to attach/secure the band to the top plate can pass through some of the cells of the web such that the shanks of such fasteners provide secondary restraint of the web against lateral movement of the edges of the web toward the encompassed space. Support bands 54, 58 are mounted and attached as part of the fall protection system if and as needed in support of the web.

Following is an illustration of how fall protection systems of the invention may be installed and used during the construction of a building. Referring to FIG. 1, a partial framework of the building is initially constructed, up to the point of having upright walls 12 assembled in place at the construction site. It matters not whether the building materials are wood, metal, or other materials. Overlying structure such as floor trusses 64, which are emplaced from ladders or scaffolding, may be assembled to the upright walls as desired, and as illustrated in FIG. 2, all without necessarily using web 38. Then for tasks where a person works from an elevated portion of the building structure without support of a ladder or scaffolding supported from the ground, web 38 is first put in place.

Web 38 is extended across the open expanse, over the encompassed space over which work is to be performed by workers at elevated heights. One or more webs are emplaced over the entirety of the open expanse. Where more than one web element is used, adjacent ones of the web elements are securely joined together, such as by sewing, along the full lengths of the adjoining edges of the webs such that a single unified web is thus deployed over the encompassed space. Typically, such joinder of webs is accomplished at the construction site, optionally after the webs have been erected over the open expanse.

The unified web, once assembled, and extended across the open expanse, is drawn down over the sides of wall 14 and/or respective trusses 84, or any other desired part of the building as has been constructed to that point. The unified web is then stretched so as to raise the web elements over the open expanse, thus providing a catch space/height between the stretched web and the underlying support/floor/ground. The web is then secured to the building structure, such as to enclosing wall 14, and/or to the ends and/or sides of any trusses. Where an open expanse of greater than a specified distance, such as 8 feet (2.4 meters), or 10 feet (3 meters), extends in any direction between building supports such as a wall 12 after the web is installed, a set of support bands 54 and/or 58 is installed under web 38. The ends of the bands are extended up through open cells at the edge of the web as illustrated for band 54 in FIG. 4. The ends of an illustrative band are extended over the top surface of top plate 28 and optionally down onto the side of the top plate. The band is then pulled tight enough to lift the band into supporting contact with the web such that the web/band combination forms a generally planar surface between supporting sides of wall 14.

Modest sag in the web/band combination is acceptable so long as the collective support provided by the web/band combination is enough to catch and retain the falling 408 pound weight anywhere over the area of the supported web and above any underlying support surface such as a floor or the ground With the web bands so tightened in support, the bands are secured to the building structure such as by driving fasteners through the bands and into some portion of the enclosing wall at or near the top of the wall as suggested in FIG. 4, or applying clamps to the bands and corresponding building structure elements.

In the alternative, bands 54 and/or 58 can be installed before web 38 is installed, whereby bands 54, 58 provide support for web 38 while the web is being mounted, stretched taut, and secured to the building structure.

In order to temporarily hold web 38 in place over the open expanse during installation, or to maintain stretch in the web while perimeter band 50, and/or support bands 54, 58 are being installed, strands of the web may be hooked over fasteners which protrude from e.g. top plate 28 or studs 26. Where reversible such fasteners such as screws are also being used for other purposes in e.g. studs 26 or top plate 28, such e.g. screws can be set in partially-backed-out positions such that the strands of the web can be temporarily hooked over the screw heads. With the strands thus hooked over the screw heads, the web is temporarily being held in place, stretched, while perimeter band 50 is laced into and out of the respective cells about the edge portion of the web and otherwise installed, and/or while support bands 54, 58 are being installed.

With the perimeter band, or multiple lengths of perimeter banding, thus laced through the edge portion of the web about generally the entire perimeter of the enclosing wall, the perimeter band, and thus web 38, is then secured to the building structure. Band 50 may be secured to the top plate, optionally the outer surface of the top plate, facing away from the encompassed space. In some instances, the perimeter band can be secured to already-installed trusses 64. In other instances the perimeter band can be secured to the top surface of the top plate or the top surface of other structure such as the trusses. Typically, perimeter band 50 is attached to an outwardly-facing outer surface of the building structure, which provides a corner turn in the web between the perimeter band and the portion of the web which extends toward/across the open expanse, and which thus supports any falling weight imposed on the web. Band 50 is attached to the building structure at spaced locations along the perimeter of the encompassed space, such as at least every 24 inches (61 cm), optionally every 16 inches (41 cm). Band 50 can be defined by multiple band elements. Ends of adjacent perimeter band elements are joined together such that the perimeter band elements collectively act together as a single unit.

Once perimeter band 50 has been securely attached to the building structure elements, any temporary securement of web 38 can, but need not, be released. Thus, where screws have been backed out on a stud or on a top plate in order to temporarily hold the web in place by hooking web strands over the screws, those screws can be fully driven if desired, or optionally withdrawn, once the perimeter band has been fully attached.

Where the perimeter band is attached to the building structure with the perimeter band in a vertical orientation, the perimeter band captures and controls the web material along a vertically-oriented surface; and the web turns a corner to become generally horizontally oriented as the web material extends across the open expanse. That turn from vertical at the edge of the web to horizontal, at the more internally-disposed supporting portion of the web, provides an additional frictional constraint on the so-retained web, which enhances the effectiveness of the holding power of the perimeter band on the web.

One of the advantages of the invention is that the web, once installed, need not be removed. Since the strands are relatively small in cross-section, materials which traditionally are used to cover studs, trusses and the like, such as sheet rock, paneling, sub-floor, or finished floor materials, can be installed directly over the web, thus retaining the web in the finished building, and effectively hiding the presence of the web from external visual inspection. The small cross-section of the web strands thus generally causes no visual deterioration of the otherwise-visual impression presented by the covering material. Such web is typically trapped between such cover material and the underlying studs and/or trusses or other ceiling or floor building structures, or the like.

Wherever herein the word "stretch" or any of its derivatives is used in connection with web 38, the primary meaning of such usage is to express the extending of the web across the open expanse with a modest degree of tension on the web. Where the web is made of generally non-stretchable material, such as a knotted net-type construction, little if any extension/elongation of strands of the web is contemplated, though some minimal amount of elongation of strands is inherent in any such tension being imposed on the web.

By contrast, where the web is made of a polymeric material, it is recognized that polymeric materials typically exhibit a degree of elongation as tensile force is applied; so a relatively greater degree of elongation is contemplated where polymeric material is used as a primary material in the web.

Thus, the primary purpose of "stretching" the web is extension of the web across the open expanse and any elongation of the web in the process of being so stretched is a function of the material of which the web is constructed. Accordingly, the web may be extended without substantial elongation, while use of polymeric material in fabricating the web typically will inherently include substantial elongation of the web as one of the design parameters in web specification.

Although the invention has been described with respect to various embodiments, it should be realized this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. In a building construction, building structure elements defining a wall which defines an encompassed space, the wall having a wall bottom and a wall top, a fall protection system extending across such encompassed space, and comprising:

(a) an open-mesh web overlying, and extending across, the encompassed space proximate the wall top, said open-mesh web comprising a matrix of open cells; and (b) a perimeter band extending about the encompassed space proximate said wall, said perimeter band extending over at least portions of said open-mesh web proximate the wall top, said perimeter band being secured to the building structure elements proximate said wall at spaced locations along said wall, thereby entrapping the at least portions of said open-mesh web between said perimeter band and the respective building structure elements along said wall, said wall having an outer surface, said perimeter band having a length, a width, and a thickness, said perimeter band being secured to the outer surface of the wall with the width of said perimeter band extending in an upright orientation.

2. In a building construction, building structure elements defining a wall which defines an encompassed space, the wall having a wall bottom and a wall top; a fall protection system extending across such encompassed space, and comprising:

(a) an open-mesh web overlying, and extending across, the encompassed space proximate the wall top, id open-mesh web comprising a matrix of open cells; and (b) a perimeter band extending about the encompassed space proximate said wall, said perimeter band extending over said open-mesh web proximate the wall top, said perimeter band being secured to the building structure elements proximate said wall at spaced locations along said wall, said web thereby being trapped by said perimeter band and held against ones of such building structural elements.

3. In a building construction, building structure elements defining a wall which defines an encompassed space, the wall having a wall bottom and a wall top, a fall protection system extending across such encompassed space, and comprising:

an open-mesh web overlying, and extending across, the encompassed space proximate the wall top, said open-mesh web comprising a matrix of open cells; and (b) a perimeter band extending about the encompassed space proximate said wall, said perimeter band extending over at least portions of said open-mesh web proximate the wall top, said perimeter band being secured to the building structure elements proximate said wall at spaced locations along said wall, further comprising a first set of support straps extending in a first direction across the encompassed space, each said support strap in the first set being attached to said wall on opposing sides of such encompassed space, adjacent upper portions of said wall, said first set of support bands supporting said open-mesh web such that said open-mesh web is generally at an elevation proximate the wall top over the encompassed space, allowing for reasonable sag in the web.

4. A fall protection system as in claim 3, further comprising a second set of support straps extending in a second direction, different from the first direction, across the encompassed space under said open-mesh web, each said support strap in the second set being attached to said wall on opposing sides of such encompassed space, adjacent such upper portions of said wall, said second set of support straps crossing the first set of support straps, said first and second sets of support straps defining a generally coordinated support, said open-mesh web extending over, and being supported by, at least portions of both of the first and second sets of support straps.

5. A fall protection system as in claim 1, said open-mesh web extending downwardly from proximate the wall top along a portion of the outer surface of said wall.

6. A fall protection system as in claim 1 wherein said open-mesh web comprises knots at respective corners of the cells.

7. A fall protection system as in claim 1 wherein said open-mesh web comprises a monolithic, substantially polymeric, structure.

8. A fall protection system as in claim 1 wherein, when said fall protection system is stressed by an object, up to about 181 kg (400 pounds), being dropped into the encompassed space from a height of up to about 107 cm (42 inches), the fall protection system captures and supports such object in less than about 2.4 meters (8 vertical feet) of supported drop.

9. A fall protection system as in claim 1 wherein said open-mesh web turns an approximately perpendicular angle between a first portion of said web which is disposed between said perimeter band and a said building structural element, and a second portion of said web which extends toward and/or across the encompassed space.

10. A fall protection system as in claim 1 wherein screws or nails, driven through said perimeter band, also pass through open cells of said opera mesh web.

11. A fall protection system as in claim 3 wherein an end of a said support strap extends up through an open cell of said web.

12. A fall protection system as in claim 4 wherein an end of a said support strap of said second set of support straps extends up through an open cell of said web.

13. A building, comprising:

(a) building structure elements defining a wall which in turn defines an encompassed space, the wall having a wall bottom and a wall top;

(b) ceiling and/or floor members extending across the encompassed space and overlying the encompassed space;

a fall protection system, extending across such encompassed space, said fall protection system comprising (i) an open-mesh web overlying, and extending across, the encompassed space proximate the wall top, said open-mesh web comprising a matrix of open cells; and (ii) a perimeter band extending about the encompassed space proximate said wall, said perimeter band extending over at least portions of said open-mesh web proximate the wall top, said perimeter band being secured to said building structure elements proximate said wall at spaced locations along said wall, thereby entrapping the at least portions of said open-mesh web between said perimeter band and said wall along said wall; and (d) internal finish materials underlying said ceiling and/or floor members, said open-mesh web being disposed between said internal finish materials and said ceiling and/or floor members.

14. A building as in claim 13 wherein said perimeter band is laced into and out of ones of the open cells of said open-mesh web proximate the wall top whereby said open-meth web is captured by said perimeter band between said perimeter band and said all.

15. A building, comprising.:

(a) building structure elements defining a wall which defines an encompassed space, the wall having a wall bottom and a wall top;

(b) ceiling and/or floor members extending across the encompassed space and overlying the encompassed space;

a fall protection system extending across such encompassed space, ail fall protection system comprising (i) an open-mesh web overlying, and extending across, the encompassed space proximate the wall top, said open-mesh web comprising a matrix of open cells; and (ii) a perimeter band extending about the encompassed space proximate said wall, said perimeter band extending over at least portions of said open-mesh web proximate the wall top, said perimeter band being secured to said building structure elements proximate said wall at spaced locations along said wall; and (d) internal finish materials covering said ceiling and/or floor framing, said open-mesh web being disposed between said internal finish materials and said ceiling and/or floor members, further comprising a first set of support bands extending in a first direction across the encompassed space, said support bands in the first set being attached to an upper portion of said wall, at least portions of said first set of support bands being disposed, across the encompassed space, between said internal finish materials and said open-mesh web.

16. A building as in claim 13, further comprising a first set of support bands extending in a first direction across the encompassed space, said support bands in the first set being attached to an upper portion of said wail, at least portions of said first set of support bands being disposed, across the encompassed space, between said internal finish materials and said open-mesh web, still further comprising a second set of support bands extending in a second direction, different from the first direction, across the encompassed space, said support bands in the second set being attached to such upper portion of said wall, at least portions of said second set of support bands crossing the first set of support bands, said second set of support bands being disposed, across the encompassed space, between said internal finish materials and said open-mesh web.

17. A building, comprising:

(a) building structure elements defining a wall which in turn defines an encompassed space, the wall having a wall bottom and a wall top;

(b) ceiling and/or floor members extending across the encompassed space and overlying the encompassed space;

(c) a fall protection system extending across such encompassed space, said fall protection system comprising (i) an open-mesh web overlying, and extending across, the encompassed space proximate the wall top, said open-mesh web comprising a matrix of open cells; and (ii) a perimeter band extending about the encompassed space proximate said wall, said perimeter band extending over at least portions of said open-mesh web proximate the wall top, said perimeter band being secured to said building structure elements proximate said wall at spaced locations along said wall; and (d) internal finish materials covering said ceiling and/or floor framing, and capturing said open-mesh web between said internal finish materials and said ceiling and/or floor members, said perimeter band having a length, a width, and a thickness, said perimeter band being secured to the outer surface of the wall with the width of said perimeter band extending in an upright orientation such that said open-mesh web turns an approximately perpendicular angle between a first portion of said web which is disposed between said perimeter band and a said building structural element, and a second portion of said web which extends toward and/or across the encompassed space.

18. A building, comprising:

(a) building structure elements defining a wall which in turn defines an encompassed space, the wall having a wall bottom, a wall top, and upright connectors extending upwardly between the wall bottom and the wall top, the wall top comprising one or more top plate elements, a given top plate element having at least one of an upwardly-facing top surface and an outer surface facing away from the encompassed space;

(b) ceiling and/or floor members extending across the encompassed space and overlying the encompassed space;

(c) a fall protection system extending across such encompassed space, said fall protection system comprising (i) an open-mesh web overlying, and extending across, the encompassed space proximate the wall top, said open-mesh web comprising a matrix of open cells; and (ii) a perimeter band extending about the encompassed space proximate said wall, said perimeter band extending over at least portions of said open-mesh web proximate the wall top, said perimeter band being secured to said building structure elements proximate said wall at spaced locations along said wall;

(d) internal finish materials covering said ceiling and/or floor framing, said open-mesh web being disposed between said internal finish materials and said ceiling and/or floor members: and (e) a set of support bands extending across the encompassed space under said open-mesh web, an end of a said support band extending up through an open cell of said web.

19. A fall protection system kit, adapted and configured for use in building construction, to extend across an open expanse encompassed by building structural elements, thereby to protect construction workers working at elevated heights, said fall protection system kit comprising:

(a) as a first component of said kit, an open-mesh web comprising a matrix of open cells, said open mesh web having an outer perimeter and being defined by one of (i) knotted substantially non-extensible strands, or (ii) a matrix of inherently extensible polymeric strands, having a Young's modulus elastic limit, in a monolithic structure wherein lengths of such matrix are joined together along sides of respective such lengths, and wherein, when said fall protection system is stressed by an object, up to about 400 pounds, being dropped onto a restrained said polymeric web from a height of 42 inches, said polymeric web is stressed beyond the Young's modulus elastic limit:

(b) as a separate and distinct component of said kit, a supply of perimeter banding, sufficient in quantity to extend about the entirety of the outer perimeter of said open-mesh web; and (c) as a third separate and distinct component of said kit, a supply of mechanical fasteners sufficient in quantity to secure said perimeter banding, and thus said open-mesh web, to such building structure elements about the entirety of the outer perimeter of said open-mesh web, with said open-mesh web disposed between said perimeter banding and respective ones of such building structure elements.

20. A fall protection system kit as in claim 19, further comprising, as a fourth separate and distinct component of said kit, a supply of support strapping adapted and configured to support said open-mesh web across such encompassed space.

21. A fall protection system as in claim 19 wherein said perimeter banding is polymeric and is free of sharp edges.

22. A fall protection system as in claim 21, further comprising, as a fourth separate and distinct component of said kit, a supply of support strapping adapted and configured to support said open-mesh web across such encompassed space, and wherein said support strapping is metallic and is free from sharp edges.

* * * * *